US005632695A

United States Patent [19]

Hlinka et al.

[11] Patent Number: 5,632,695

[45] Date of Patent: May 27, 1997

[54] GOLF CLUBHEAD

[75] Inventors: Edward A. Hlinka, Carol Stream, Ill.; Dwight J. Niswander, Camarillo, Calif.; Carl E. Scheie, Libertyville, Ill.; Edward A. Schield, Granada Hills, Calif.; James L. Shenoha, Lockport, Ill.

[73] Assignee: Wilson Sporting Goods Co., Chicago, Ill.

[21] Appl. No.: 393,061

[22] Filed: Mar. 1, 1995

[51] Int. Cl.[6] ..... A63B 53/02

[52] U.S. Cl. ..... 473/341; 473/305

[58] Field of Search ..... 273/80.2, 80.4, 273/80.3, 80.5, 80.7, 80.8, 163 R, 164.1, 167 D, 167 A, 167 E, 167 F, 167 G, 167 H, 167 K, 167 J, 169, 174, 171, 172, 173

[56] References Cited

U.S. PATENT DOCUMENTS

| | | | |
|---|---|---|---|
| D. 172,459 | 6/1954 | Beveridge . | |
| D. 343,434 | 1/1994 | Helmstetter . | |
| D. 344,117 | 2/1994 | Helmstetter . | |
| D. 344,997 | 3/1994 | Allen . | |
| D. 366,682 | 1/1996 | Antonious . | |
| 1,291,967 | 1/1919 | McDougal . | |
| 1,994,149 | 3/1935 | Root . | |
| 2,003,951 | 6/1935 | Pepin . | |
| 2,067,556 | 1/1937 | Wettlaufer . | |
| 2,201,638 | 5/1940 | Theibault . | |
| 2,250,950 | 9/1941 | Miller . | |
| 2,550,846 | 5/1951 | Milligan . | |
| 2,756,055 | 7/1956 | Bittner | 273/164.1 |
| 2,880,002 | 3/1959 | Wetty . | |
| 3,199,872 | 8/1965 | Taylor . | |
| 3,519,271 | 7/1970 | Smith . | |
| 3,595,577 | 7/1971 | Hodge . | |
| 3,625,618 | 12/1971 | Solheim . | |
| 3,759,517 | 9/1973 | Mills . | |
| 3,810,621 | 5/1974 | Mills . | |
| 3,819,181 | 6/1974 | Mills . | |
| 3,825,991 | 7/1974 | Cornell . | |
| 3,985,363 | 10/1976 | Jepson . | |
| 3,997,170 | 12/1976 | Goldberg . | |
| 4,023,802 | 5/1977 | Jepson . | |
| 4,157,830 | 6/1979 | Taylor . | |
| 4,417,731 | 11/1983 | Yamada . | |
| 4,471,961 | 9/1984 | Masghati . | |
| 4,697,813 | 10/1987 | Inoue . | |
| 4,776,594 | 10/1988 | Rango . | |
| 4,838,555 | 6/1989 | Kobayashi . | |
| 4,948,132 | 8/1990 | Wharton . | |
| 4,960,279 | 10/1990 | Harris . | |
| 4,995,609 | 2/1991 | Parente et al. | 273/169 |
| 5,042,806 | 8/1991 | Helmstetter . | |
| 5,067,715 | 11/1991 | Schmidt . | |
| 5,092,599 | 3/1992 | Okumoto . | |
| 5,120,062 | 6/1992 | Scheie . | |
| 5,163,682 | 11/1992 | Schmidt . | |
| 5,180,166 | 1/1993 | Schmidt . | |
| 5,184,819 | 2/1993 | Desbiolles . | |
| 5,204,046 | 4/1993 | Schmidt . | |

(List continued on next page.)

FOREIGN PATENT DOCUMENTS

| | | |
|---|---|---|
| 2225725 | 6/1990 | United Kingdom . |
| 2230459 | 10/1990 | United Kingdom . |
| WO90/00424 | 1/1990 | WIPO . |

*Primary Examiner*—Steven B. Wong

[57] ABSTRACT

A wood type golf clubhead includes a face, a sole, a crown, a toe portion, a heel portion, and a hosel portion adjacent the heel portion. The hosel portion has an inverted or recessed portion which includes a generally concave wall. A hosel tube extends upwardly from the hosel portion. The hosel tube is supported within a boss which is formed integrally with the inside surface of the face. An alignment groove is provided at the intersection between the face and the crown, and the groove includes a surface which lies within a plane which is substantially vertical when the clubhead is soled at address. The sole includes a flat portion for supporting the clubhead at address, and a rear wall curves upwardly and rearwardly from the flat portion to the crown. The toe portion and the crown merge at a relatively sharp angle to provide a streamlined shape.

14 Claims, 3 Drawing Sheets

U.S. PATENT DOCUMENTS 5,205,552 4/1993 Green .
5,221,086 6/1993 Antonious .
5,230,510 7/1993 Duclos ..... 273/167 F
5,232,224 8/1993 Zeider .
5,240,252 8/1993 Schmidt .
5,255,914 10/1993 Schroder .
5,257,786 11/1993 Gorman .
5,272,802 12/1993 Stites, III .
5,301,941 4/1994 Allen .
5,301,945 4/1994 Schmidt .
5,318,300 6/1994 Schmidt .
5,322,287 6/1994 Okumoto .
5,335,909 8/1994 Green .
5,346,217 9/1994 Tsuchiya .
5,346,218 9/1994 Wyte ..... 273/167 H
5,351,958 10/1994 Helmstetter .
5,441,263 8/1995 Gorman ..... 273/174
5,452,890 9/1995 Bingman ..... 273/80.2
5,460,371 10/1995 Takeda ..... 273/80.2

GOLF CLUBHEAD

BACKGROUND

This invention relates to a wood type of golf clubhead. More particularly the invention relates to a golf clubhead which has a recessed or inverted hosel portion, an alignment groove for aligning the clubhead, a flat sole portion, and an aerodynamic shape.

Golf clubs of the wood type are no longer made only from wood. Such clubs are now commonly made from metal such as stainless steel, titanium, and aluminum and from composite material such as fibers of graphite, Kevlar™, or boron and resin.

Many golf clubheads include a hosel which extends upwardly above the face of the clubhead for attaching the shaft of the clubhead. However, a conventional hosel increases weight in the high heel area. It is becoming increasingly common for golf club designers to redistribute the weight of the clubhead to the high toe and low heel areas as taught, for example, by U.S. Pat. Nos. 4,471,961 and 5,120,062.

Some clubheads have used a shorter hosel to reduce weight in the high heel area. For example, U.S. Pat. Nos. 5,042,806 and 5,240,252 describe clubheads in which the hosel does not extend above the face. However, such a clubhead does not provide the same support for the shaft as does a clubhead with a traditional hosel.

Another problem with wood type clubheads is properly aligning the face of the clubhead. With iron type clubheads many golfers use the bottom groove of the face to align the clubhead square, i.e., perpendicular, to the intended line of flight. The top line of an iron clubhead cannot be used to align the clubhead because the top line is not perpendicular to the intended line of flight as viewed by a golfer at address.

However, the face of a wood type golf club has a low loft angle, and the grooves of the face are not easily apparent and usable for alignment at address. Using the face grooves for alignment is also complicated by the fact that the face of most wood type clubheads is provided with bulge and roll curvature, as explained, for example, in U.S. Pat. No. 4,471,961.

Many wood type golf clubs therefore include some alignment indicator such as a line or arrow on the top of the clubhead which indicates the intended line of flight. However, some golfers prefer to use the face for aligning the clubhead square rather than relying on an indicator on top of the clubhead.

SUMMARY OF THE INVENTION

In accordance with the invention, a clubhead is provided with an inverted or recessed hosel area. The inverted hosel area includes a generally concave wall which curves toward the sole of the clubhead and reduces the weight in the high heel area. The shaft is reinforced by a hosel tube which extends upwardly from the inverted hosel area. The hosel tube is formed from a light yet strong material, such as titanium, to minimize the weight in the hosel area.

The clubhead is also provided with an alignment groove at the intersection of the face and the crown of the clubhead. A portion of the alignment groove lies in a vertical plane which is perpendicular to the midplane of the clubhead and allows a golfer to align the clubhead square to the line of flight.

The sole includes a flat portion which supports the clubhead in the address position. The toe portion and rear portion of the club extend upwardly from the flat portion to merge with the crown in a generally V-shaped aerodynamic profile.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
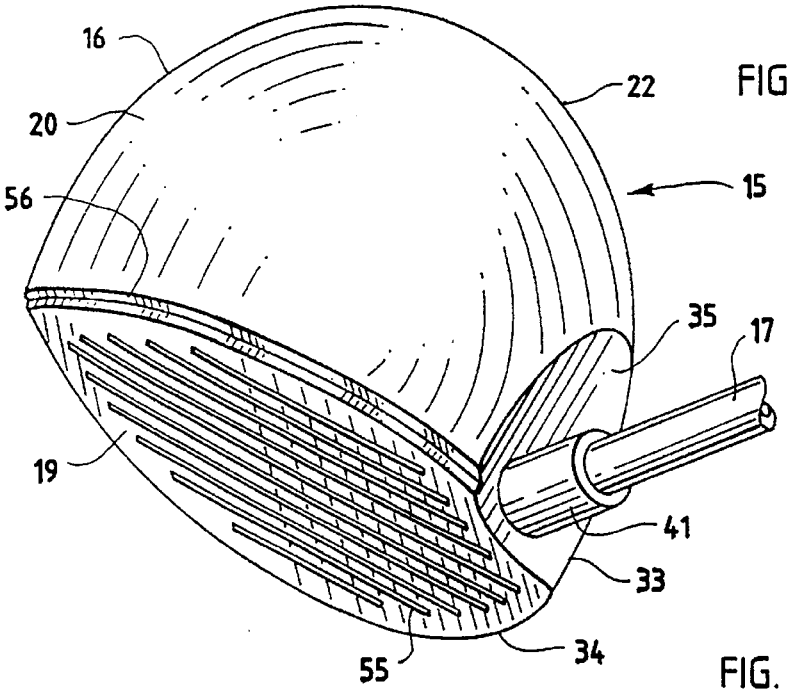
FIG. 1 is a fragmentary perspective view of a golf club formed in accordance with the invention.

FIG. 1 illustrates a wood type of golf club 15 which includes a clubhead 16 and a shaft 17. The particular clubhead illustrated is formed from metal, but the clubhead can also be formed from other material such as wood and composites.

The clubhead includes a face 19, a generally convex top portion or crown 20, and a generally convex bottom portion 21. The top and bottom portions merge to form a curved peripheral edge 22 which is relatively sharp or streamlined (FIGS. 2, 4, 5, and 6).

The bottom portion of the clubhead includes a sole 24, a toe wall 25 (FIG. 2) which merges with the edge 22, a rear wall 26 (FIGS. 4 and 5) which merges with the edge 22, and a heel wall 27 (FIG. 2) which merges with the edge 22. The toe wall 25 forms a relatively sharp included angle with the crown 20 at the edge 22, i.e. an angle which is no greater than about 90°. The rear wall 26 also forms a relatively sharp included angle with the crown 20 at the edge 22. The angle formed by the rear wall 26 and crown 20 is substantially the same as the angle formed by the toe wall 25 and the crown 20, i.e. it is also a relatively sharp angle which is no greater than about 90°.

Figure 2:
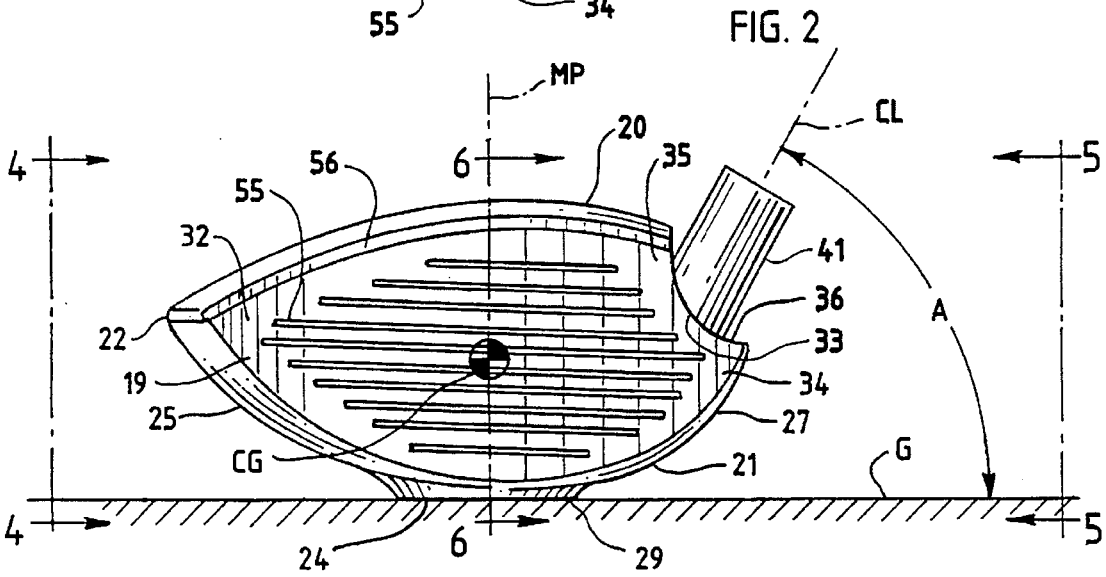
FIG. 2 is a front elevational view of the clubhead.
Figure 6:
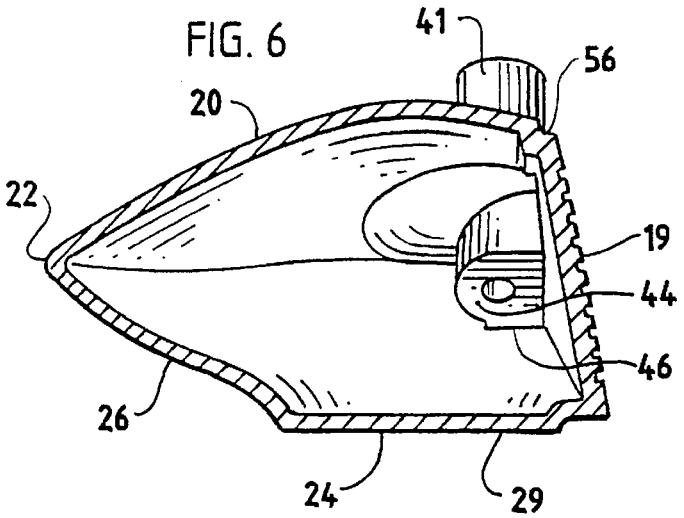
FIG. 6 is a sectional view taken along the line 6—6 of FIG. 3.
Figure 8:
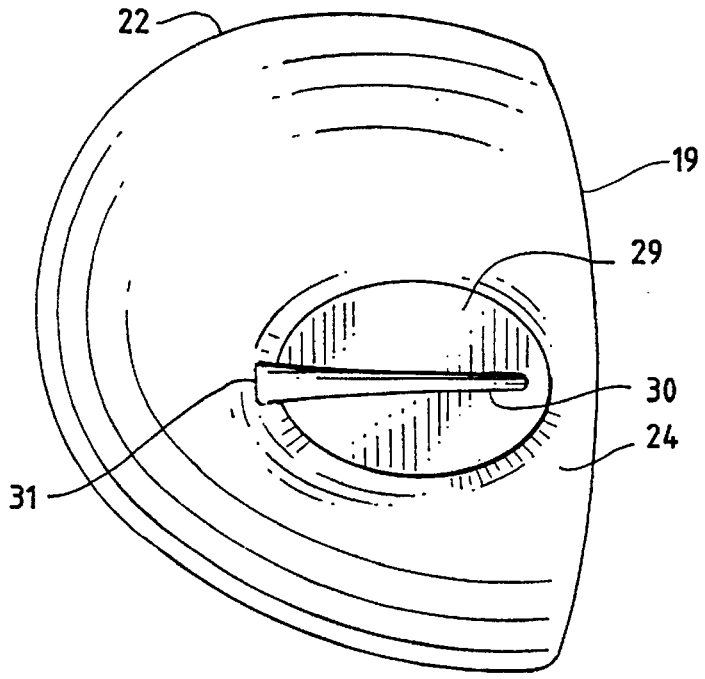
FIG. 8 is a bottom view of the clubhead.

The sole 24 includes a flat portion or pad 29 (FIGS. 2, 6, and 8). The flat portion is designed to support the clubhead on the ground at address in the proper loft and lie orientation. Although individual golfers might hold a particular clubhead differently at address, clubheads are designed with specific loft and lie angles which are measured with respect to one orientation of the club. See, for example, the discussion in U.S. Pat. No. 5,150,550.

Figure 4:
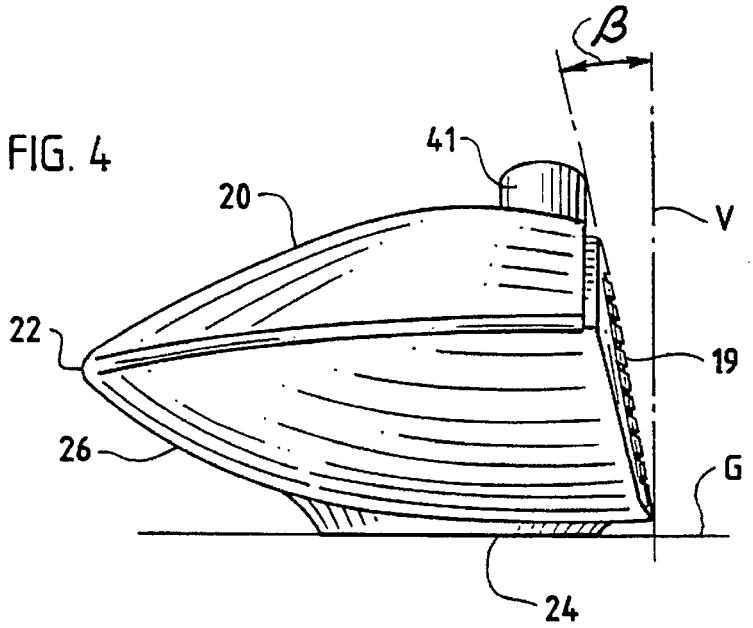
FIG. 4 is a toe end view of the clubhead taken along the line 4—4 of FIG. 2.

Referring to FIG. 2, the angle A between the centerline CL of the shaft and a horizontal ground plane G determines the lie of the clubhead. Referring to FIG. 4, the angle B between the face 19 and a vertical plane V determines the loft of the clubhead. If the face includes bulge and/or roll curvature and is not planar, the loft angle is determined by a plane which is tangent to the center of the face. The tangent plane extends perpendicularly to a vertical midplane MP which extends through the center of the face perpendicular to the ground plane G and the vertical plane V. The flat portion 19 of the sole is coplanar with the ground plane G at address, and the size of the flat portion is preferably sufficient to provide tactile feedback to the golfer to enable the golfer to be aware of the correct address position.

A groove 30 (FIG. 8) is provided in the sole pad 29 to facilitate moving the flat portion through turf, soil, or sand as the clubhead impacts the ball, the groove is aligned with the midplane MP and terminates in a flared rear end 31.

Figure 5:
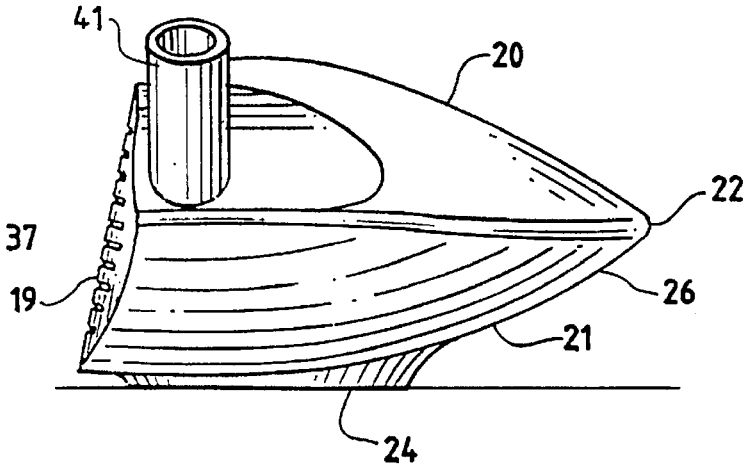
FIG. 5 is a heel end view of the clubhead taken along the line 5—5 of FIG. 2.

The rear wall 26 is slightly convex in FIGS. 4–6 and curves upwardly and rearwardly from the sole pad 29 to the edge 22. The toe wall 25 and heel wall 27 are also generally convex and curve outwardly and upwardly to the edge 22. The toe portion 32 of the face (FIG. 2) is relative sharp and V-shaped, and the included angle of the V-shaped toe portion 32 of the face is about 90°. A continuous curved outer periphery is formed at the edge 22 of the clubhead by the intersections of the crown with the toe wall, the rear wall, and the heel wall.

Figure 9:
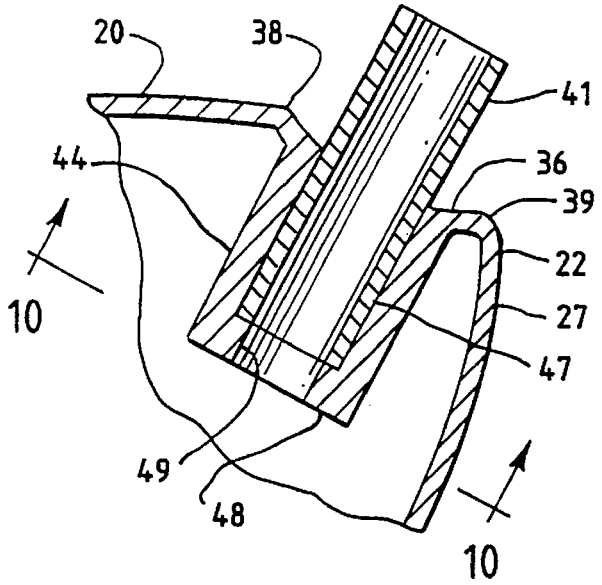
FIG. 9 is a fragmentary sectional view taking the line 9—9 of FIG. 3.

A hosel portion 33 is located at the juncture between the crown 20 and the heel portion 34 of the face. The hosel portion includes an inverted or recessed portion 35 which is provided by a generally arcuate or concave wall 36. Referring to FIGS. 2 and 9, the concave wall 36 curves inwardly from the edge 22 toward the toe and upwardly toward the crown. The concave wall is generally channel-shaped and extends along an axis 37 (FIGS. 3 and 5) which is preferably substantially perpendicular to the vertical plane V at address.

In one specific embodiment of the invention, the concave wall was circular and had a radius of about ½ inch. The wall extended over an arc of about 90°. The maximum depth of the recess measured from a line extending across the recess from the shoulder 38 at the crown to the shoulder 39 at the heel was about 0.15 inch.

A hosel tube 41 extends upwardly from the center of the inverted portion 35 beyond the top of the crown 20. The shaft 17 is secured within the hosel tube by epoxy or adhesive. The hosel tube is preferably formed from titanium which is strong yet lightweight. The titanium tube reinforces the shaft without contributing excessive weight to the high heel area. However, the hosel tube can also be made of the same material as the clubhead, such as stainless steel and can also be formed integrally with the clubhead during the casting process.

The inverted portion 35 of the hosel reduces the amount of material and the weight in the hosel area. The reduction in weight in the hosel area enables weight to be redistributed to other areas of the clubhead, for example the high toe and low heel areas. The inverted portion also lowers the center of gravity of the clubhead and reduces drag or air resistance as the clubhead is swung. The combination of the inverted portion and the streamlined or tear drop shaped profile provided by the sharp peripheral edge 22 improves the aerodynamic features of the clubhead.

The inverted hosel portion also positions the shaft centerline farther from the heel and closer to the center of gravity CG (FIG. 2) of the clubhead. Since the hosel tube 41 and the shaft extend through the center of the concave wall 36, the shaft is spaced away from the shoulder 39 on the heel.

The particular clubhead illustrated in FIGS. 1–11 is formed from 17-4 stainless steel by investment casting. As is well known in clubhead manufacturing, the investment casting process forms a hollow clubhead with an open bottom. The opening in the bottom is closed by a soleplate which is welded to the periphery of the opening.

Figure 10:
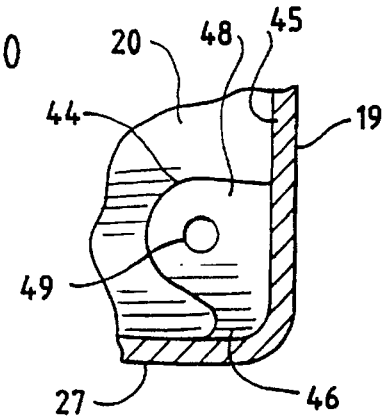
FIG. 10 is a fragmentary sectional view taken along the line 10—10 of FIG. 9.
Figure 11:
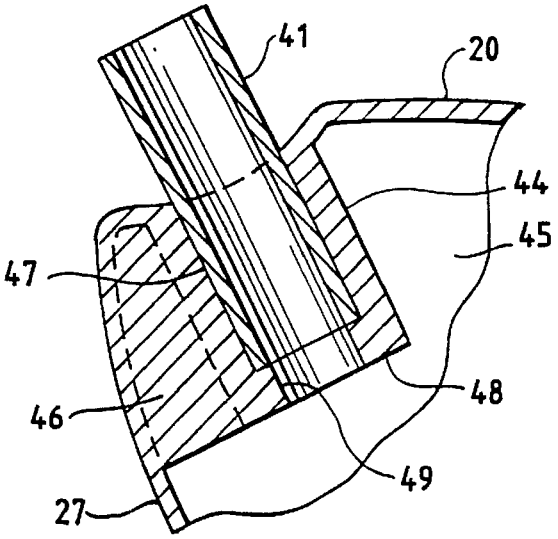
FIG. 11 is a fragmentary sectional view taken along the line 11—11 of FIG. 3.

Referring to FIGS. 9–11, a generally cylindrical boss or lug 44 is formed integrally with the rear surface 45 of the face. A portion of the boss advantageously extends to the heel wall 27 along the inside surface of the face to form an internal casting gate 46 for the molten metal which forms the clubhead.

As described in U.S. Pat. No. 5,346,218, a mold for casting a metal clubhead conventionally includes an external gate through which the molten metal is poured. However, molds for large clubheads advantageously also include internal gates to facilitate flow of molten metal throughout the mold cavity. The boss 44 is formed by an internal gate in the mold which communicates with the conventional external gate at the heel portion of the mold. The internal gate facilitates the casting of the boss, the face, and the crown and also provides weight in the low heel area of the clubhead.

The boss is cast with an internal cylindrical bore 47 (FIG. 9) for the hosel tube 41. The hosel is permanently secured within the bore by epoxy. The hosel can also be additionally or alternately secured by screw threads, mechanical force fit, interlock mechanism, etc. The bore terminates in a bottom wall 48 which supports the bottom of the hosel tube and the shaft. The bottom wall is provided with an opening 49 to permit the clubhead to be filled with polyurethane foam if desired.

The clubhead can also be cast from titanium or other suitable metal. Titanium is lighter than stainless steel and a titanium clubhead can be larger than a steel clubhead of the same weight. Since molten titanium flows more easily than molten steel, a titanium clubhead does not need an internal gate for the boss 44. The boss of a titanium clubhead can be formed integrally with the rear surface of the face 52 of the clubhead but does not need to extend to the heel wall.

Referring to FIGS. 1 and 2, the front surface of the face 19 of the clubhead 16 is provided with conventional grooves 55 which are substantially parallel to the ground plane G. The specific embodiment of the clubhead which is illustrated in the drawing included bulge and roll curvatures which were oriented about axes 45° from the ground plane as described in U.S. Pat. No. 4,471,961.

Figure 3:
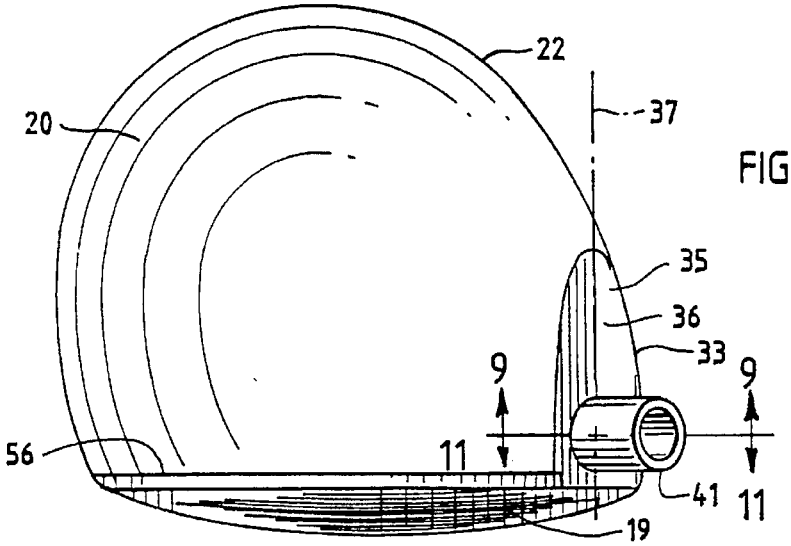
FIG. 3 is a top view of the clubhead.
Figure 7:
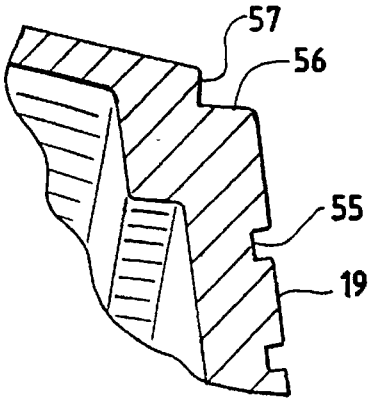
FIG. 7 is an enlarged fragmentary view of a portion of FIG. 7.

An alignment groove, cut, or recess 56 is provided at the intersection between the face 19 and the crown 20. The alignment groove curves upwardly between the toe portion and the heel portion of the edge 22 and forms the top edge of the face and the front edge of the crown. Referring to FIGS. 3, 4, and 7, the alignment groove includes a rear surface 57 which lies in a plane which is parallel to or substantially parallel to the vertical plane V.

The alignment groove is readily visible to the golfer at address and enables the golfer to align the clubhead by squaring the alignment groove to the intended line of flight. Even though the alignment groove follows the curvature of the crown 20, it appears straight or substantially straight to the golfer when viewed at address, particularly because the rear surface of the groove lies in a substantially vertical plane and is therefore substantially straight.

If desired,, the plane of the alignment groove can be angled with respect to the face to provide an open or closed face when the alignment groove is squared in order to compensate for a hook or a slice.

In the preferred embodiment the alignment groove is located at the intersection of the face and crown. However, the alignment groove could also be located on the crown behind the face or on the face below the crown. The alignment groove is preferably formed during the casting process.

Alternatively, alignment means could be provided by a painted or cut line or other indicia which extended substantially parallel to the vertical plane V.

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A metal wood type clubhead comprising a face, a sole, a crown, a toe wall, a heel wall, and a hosel portion which form an outer surface of the clubhead, the hosel portion including a recessed portion which extends from the crown and heel wall toward the sole, the recessed portion including a generally concave wall which is generally U-shaped in cross section in a plane which extends generally parallel to the face and which forms a portion of said outer surface of the clubhead.

2. The clubhead of claim 1 in which the recessed portion of the hosel portion extends from the heel wall toward the toe wall and curves upwardly to the crown.

3. The clubhead of claim 1 including a hosel tube which extends upwardly from the hosel portion.

4. The clubhead of claim 3 in which the face includes inner and outer surfaces, and a boss inside of the clubhead which is integral with the inner surface of the face, the boss having a generally cylindrical bore which extends through the hosel portion.

5. The clubhead of claim 4 in which the boss includes a gate portion which is integral with the heel wall for casting the heel wall, the face, and the boss.

6. The clubhead of claim 4 in which the hosel tube is secured within the bore of the boss.

7. The clubhead of claim 1 in which the face includes a top portion which merges with the crown, the clubhead being provided with an alignment groove adjacent the area of merger between the face and the crown, the alignment groove including a surface which lies in a plane which extends generally vertically when the clubhead is soled at address.

8. The clubhead of claim 7 in which the crown is generally convex and has a curved front edge which curves upwardly between the toe wall, and the heel wall, the alignment groove curving along the front edge of the crown.

9. The clubhead of claim 7 in which the face includes a curved top edge which curves upwardly between the toe wall and the heel wall, the alignment groove curving along the top edge of the face.

10. The clubhead of claim 1 in which the sole includes a flat portion which is adapted to support the clubhead when the clubhead is soled on the ground at address.

11. The clubhead of claim 10 in which the flat portion is provided with a groove which extends in a plane which is generally perpendicularly to the face.

12. The clubhead of claim 10 in which the clubhead includes a rear wall which curves upwardly from the flat portion and away from the face and merges with the crown to form a curved rear edge.

13. The clubhead of claim 12 in which the crown merges with the toe wall to form a toe edge, and the crown merges with the heel wall to form a a curved heel edge, said toe edge, said toe edge, said rear edge and said curved heel edge forming a continuous curved outer periphery, the toe wall and the crown forming an included angle at the toe edge which is no greater than about 90°.

14. The clubhead of claim 13 in which the rear wall and the crown form an included angle at the rear edge which is no greater than about 90°.

* * * * *